United States Patent [19]

Tamburrino

[11] Patent Number: 4,517,487

[45] Date of Patent: May 14, 1985

[54] CATHODE RAY TUBE INTERNAL SHIELDING MEANS

[75] Inventor: Richard A. Tamburrino, Auburn, N.Y.

[73] Assignee: North American Philips Consumer Electronics Corp., New York, N.Y.

[21] Appl. No.: 475,266

[22] Filed: Mar. 14, 1983

[51] Int. Cl.[3] ..... H01J 29/06

[52] U.S. Cl. ..... 313/407; 315/85

[58] Field of Search ..... 313/407, 402, 479; 315/8, 85

[56] References Cited

U.S. PATENT DOCUMENTS

| | | | |
|---|---|---|---|
| 4,099,086 | 7/1978 | Röder et al. | 313/407 |
| 4,327,307 | 4/1982 | Penird et al. | 313/407 |
| 4,385,256 | 5/1983 | Tokita et al. | 313/407 |

FOREIGN PATENT DOCUMENTS

| | | | |
|---|---|---|---|
| 18165 | 10/1977 | Japan | 313/407 |

*Primary Examiner*—Palmer Demeo

*Attorney, Agent, or Firm*—Thomas A. Briody; Jack Oisher; John C. Fox

[57] ABSTRACT

This invention relates to improved CRT internal magnetic shielding means in the form of at least two one-piece substantially longitudinal open trough-like metallic shielding members of arcuate cross-sectional construction having closed rounded ends. Each member incorporates strengthening features and is free of constructional jointures. The members are attached to the rear of the supporting frame of the screen-related apertured member, being oriented at the top and bottom thereof with their longitudinal openings in facing relationship.

6 Claims, 5 Drawing Figures

CATHODE RAY TUBE INTERNAL SHIELDING MEANS

BACKGROUND OF THE INVENTION

1. Field of the Invention

The invention relates to internal magnetic shielding means for a cathode ray tube, and more particularly to improved CRT shielding means for tubes utilized in color display applications, such means being facilely fabricated and evidencing strengthening features, lightness in weight, and minimum of bulk.

2. Description of the Prior Art

Cathode ray tubes, such as those used in color television and related display applications, are often individually provided with a magnetic shielding arrangement to protect them from numerous stray voltages, currents, and magnetic fields, including the earth's magnetic field, which tend to adversely effect the desired performance of the tube. While shielding means oriented to externally encompass the funnel portion of the tube have been extensively utilized, it has been found that magnetic shielding means internally disposed within the tube envelope provide better shielding, thereby promoting marked improvement in tube performance.

In one phase of the prior art, substantially infundibular (funnel)-shaped internal shields have been positioned rearward of the screen masking member and affixed to the frame thereof. These shields are relatively expensive to fabricate and install, and represent the addition of considerable bulk and weight to the host mask-frame assembly.

A lighter and less bulky type of internal shielding means is also evidenced in the art as a pair of elongated open metallic channel-like members each having planar sides and a flat bottom intermediate thereto. These members are affixed to the top and bottom portions of the mask framing member in facing relationship. The terminal portions of these channel members are cut, bent, and welded to provide closed ends for the structure. The manufacture of these box-like closed-ended members represents several fabrication steps which are reflected in the final cost of such structures.

Summary of the Invention

Accordingly, it is an object of the present invention to provide improved internal magnetic shielding means that are light in weight and expeditiously fabricated in a manner to impart increased rigidity to the structures.

The shielding means of the invention is preferably intended for usage in tubes having substantially rectangular multi-opening or mask members spatially encompassed by the panel portion of the tube. An exemplary such mask member has a perimetrical supporting frame integrally formed of two substantially horizontal top and bottom framing elements (said to have respective twelve and six o'clock orientations) and two substantially vertical side elements (said to have respective three and nine o'clock orientations).

The improved shielding means are in the form of at least two substantially longitudinal open trough-like metallic shielding members that are substantially arcuate in cross section, such as substantially semi-circular. Each of these members is fabricated as a continuous one-piece drawn structure free of angular bends and having rounded closed ends. Such shaping is preferably obtained by a stamping-shaping operation wherein some of the metallic material is slightly shifted and disposed as minute pressed folds to effect the arcuate channel while additionally imparting beneficial rigidity to the structure.

Each channel member also evidences at least two pedestal-like protuberances on one curved side thereof to seat upon and be affixed to the ledge of the mask-framing member.

A first of these longitudinal shielding members is affixed horizontally to the twelve o'clock element of the mask-framing member and oriented with the opening thereof facing the six o'clock framing element. In a similar but reversed manner, the second of these shielding members is affixed horizontally to the six o'clock framing element and oriented with the opening thereof facing the twelve o'clock framing element.

Where additional shielding is required, similar trough-like shielding members can also be affixed to the vertically oriented three and nine o'clock framing elements.

It is preferable that the longitudinal dimension of each shielding member approximates the length dimension of the framing element to which it is attached.

Description of the Preferred Embodiment

For a fuller understanding of the present invention, together with other and further objects, advantages, and capabilities thereof, reference is made to the following disclosure and appended claims in conjunction with the accompanying drawings.

Figures 1, 2, 3:
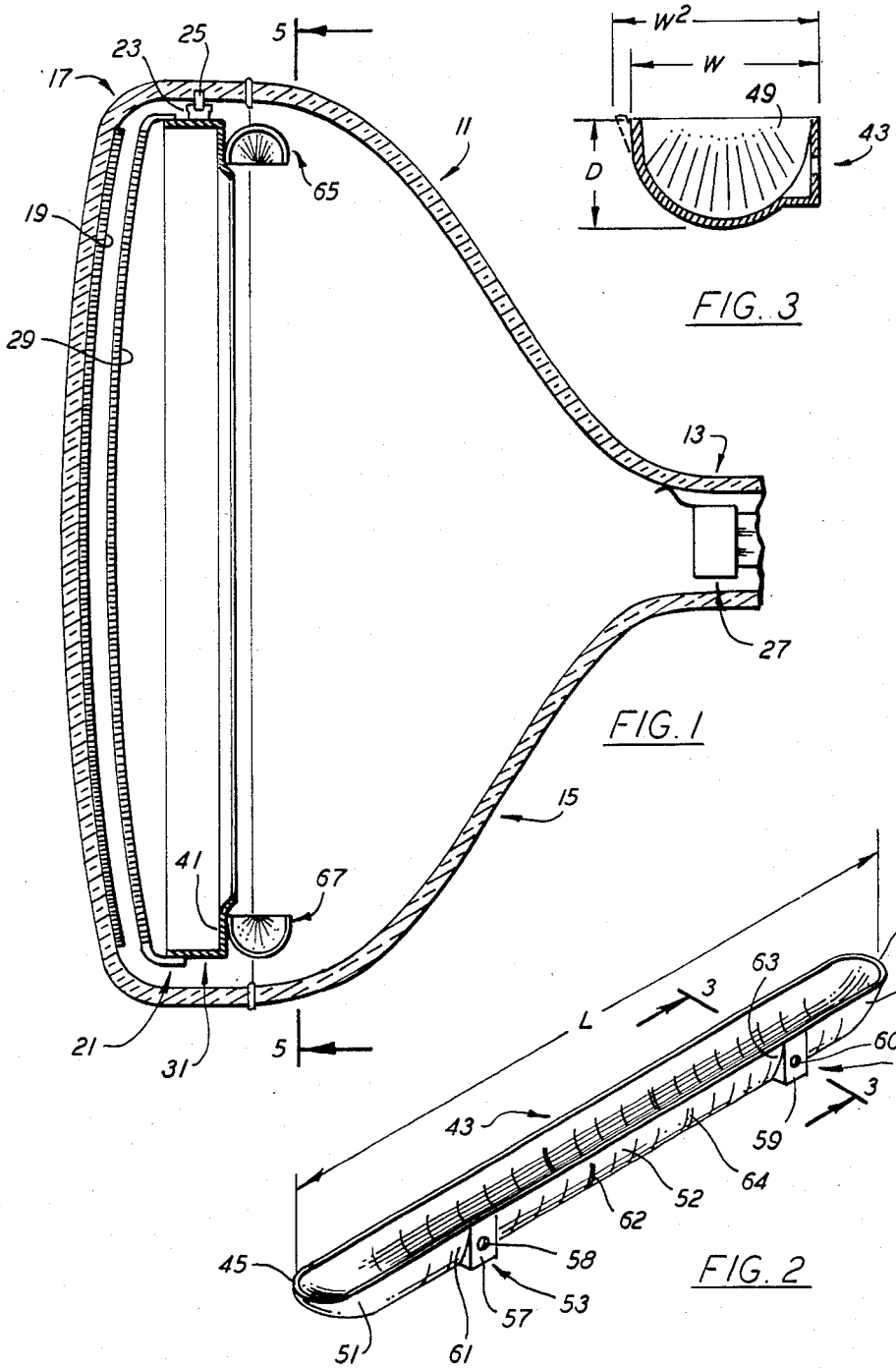
FIG. 1 is a cross-sectional view of a cathode ray tube wherein the improved shielding means of the invention are employed.
FIG. 2 is a perspective view illustrating the trough-like shaping of a shielding member.
FIG. 3 is a cross-sectional view of the member taken along the line 3—3 in FIG. 2.

With reference to the drawings, there is shown in FIG. 1 an exemplary color cathode ray tube (CRT) 11 having an envelope enclosure comprised of an integration of neck 13, funnel 15, and viewing panel 17 portions. Disposed on the interior surface of the viewing panel is a patterned cathodoluminescent screen 19 formed of a repetitive array of color-emitting phosphor components in keeping with the state of the art. A multi-opening structure 21, such as an apertured shadow mask, is oriented within the viewing panel, in spatial relationship to the patterned screen, by a plurality of cooperating support means 23 and mating panel-embedded studs 25. Encompassed within the forward region of the neck portion 13 is an electron gun assembly 27 from which electron beams are directed toward the screen 19.

Figure 4:
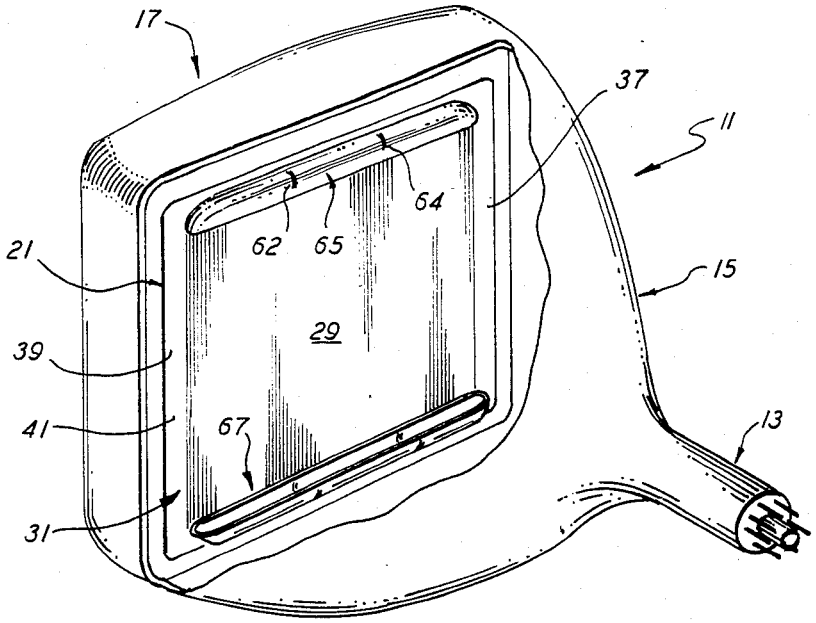
FIG. 4 is a partially sectioned perspective illustration showing the internal horizontal positioning of two shielding members.
Figure 5:
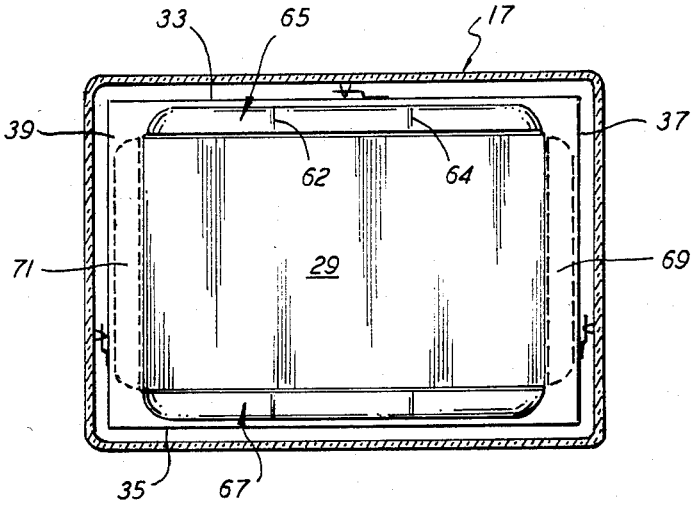
FIG. 5 is a plan view of the front portion of the tube taken along the plane 5—5 in FIG. 1, showing two additional (vertical) shielding members in phantom.

As delineated in FIGS. 1, 4, and 5, the multi-opening or mask-like member 21, in this instance being substantially rectangular, is comprised of a multi-apertured portion 29 attached to a perimetrical supporting frame 31. This framing member is formed of an integration of four framing elements, two of which are substantially horizontal elements 33 and 35 of substantially twelve and six o'clock orientations; and two substantially vertical elements 37 and 39 of substantially three and nine o'clock orientations. These integrated elements evidence a continuous rear-oriented instanding ledge 41 formed perimetrically thereabout. It is with this ledge that the improved shielding means of the invention are associated.

The invention in its simplest form utilizes two substantially longitudinal open trough-like metallic shielding members of the type illustrated in FIG. 2 and denoted as 43. Each of these members is formed free of angular bends as a continuous one-piece structure of substantially arcuate cross-section, as shown in FIG. 3. The terminii of each member are advantageously formed as rounded closed ends 45 and 47. Such end shapings may be formed in an efficient stamping-shaping operation wherein some of the material is disposed as a multiplicity of minutely pressed strengthening folds or crimps, such as 49 and 51. These conform to the arcuate shaping and provide beneficial rigidity to the structure.

Along one side 52 of each member the formation of suitable pedestal-like protuberances is effected as by shaped pressing during fabrication. As shown, two such pedestals 53 and 55 are formed in spaced relationship. Each of these pedestals evidences a seating area 57 and 59 for placement against a respective framing element, and apertures 58 and 60 may be fabricated in the respective seating areas for the accommodation of suitable attachment means to effect subsequent affixation to the supporting frame 31. The pressed formation of these respective protuberances produces additional crimps or folds of material adjacent thereto, such as 61 and 63 which further augment the rigidity of the shielding member. Additionally, at least two arcuate strengthening ribs, such as G2 and G4, may be formed in the structure, preferably between the pedestals.

In utilizing the aforedescribed shielding means in a CRT, as shown in FIGS. 1, 4, and 5, a first shielding member 65 is seated against and affixed, by suitable means, in a horizontal position on the instanding ledge of the twelve o'clock framing element 33 of the supporting frame 31. The longitudinal opening of this first shielding member is oriented to face downward toward the six o'clock framing element 35. The second or cooperating shielding member 67 is seated on and affixed to the six o'clock framing element 35, with the shield opening facing upward toward the opposed first shielding member 65.

When additional shielding is required, similar shielding members 69 and 71 are seated on and suitably attached to the three and nine o'clock vertically oriented framing elements 37 and 39, as denoted in phantom in FIG. 5.

A typical shielding member 43, as delineated in FIGS. 2 and 3, is fabricated of, for example, 6 mil cold rolled steel material. The longitudinal dimension L of each such structure approximates the length dimension of the respective framing element to which it is subsequently attached. In an exemplary 13 V or Y tube, the L dimension is in the order of 9.66 inches (245.36 mm) and the depth D of the arcuate cross-section is in the order of 0.657 inches (16.69 mm). While the arcuate crosssectional formation of the member is shown as being of substantially semi-circular shaping having a width W, the width may be flared somewhat as phantomed in FIG. 3 and denoted as $W^2$. In view thereof, the exemplary width of the arcuate channel for a 13 V CRT is in the order of being $\geqq$ 1.046 inches (26.57 mm).

The members comprising the improved shielding means of the invention may be expeditiously and inexpensively fabricated in a one draw forming and stamping operation in a manner to effect a ruggedized construction. Each shielding member is thus free of welds or constructional jointures and extra forming steps.

While there have been shown and described what are at present considered to be the preferred embodiments of the invention, it will be obvious to those skilled in the art that various changes and modifications may be made therein without departing from the scope of the invention as defined in the appended claims. For example, if the supporting frame of the multi-opening member is comprised of substantially curved elements, the respective shielding members may be longitudinally formed to substantially conform therewith.

I claim:

1. Internal magnetic shielding means for a cathode ray tube having a substantially rectangular multiopening member spatially encompassed by the panel portion of said tube, said member having a perimetrical supporting frame integrally formed of two substantially horizontal framing elements of substantially twelve and six o'clock orientations and two substantially vertical elements of substantially three and nine o'clock orientations, and a continuous rear-oriented instanding ledge formed perimetrically thereabout, said magnetic shielding means comprising:

at least two substantially longitudinal open trough-like metallic shielding members of substantially arcuate cross-section, each of said members being formed free of angular bends as a continuous one-piece structure; a first of said shielding members being affixed horizontally to said twelve o'clock framing element and oriented with the longitudinal opening thereof facing said six o'clock framing element; and a second of said shielding members being affixed horizontally to said six o'clock framing element and oriented with the longitudinal opening thereof facing said twelve o'clock framing element, and wherein each of said substantially longitudinal shielding members has pedestal-like protruberance means on one side thereof seating on and affixed to the ledge of said frame.

2. The cathode ray tube internal magnetic shielding means according to claim 1 wherein each of said shielding members has rounded and closed ends, to provide beneficially rigidity to the structure.

3. The cathode ray tube internal magnetic shielding means according to claim 1 wherein the longitudinal dimension of each trough-like shielding structure approximates the length dimension of the framing element to which it is attached.

4. The cathode ray tube internal magnetic shielding means according to claim 1 wherein trough-like shielding members are also affixed to the vertically oriented three and nine o'clock framing elements.

5. The cathode ray tube internal magnetic shielding means according to claim 1 wherein the arcuate cross sectional shaping of each shielding member is a substantially semi-circular formation.

6. The cathode ray tube internal magnetic shielding means according to claim 1 wherein each of said trough-like shielding members has at least two spaced-apart arcuately oriented strengthening ribs.

* * * * *